US008074631B2

(12) United States Patent
Hu et al.

(10) Patent No.: US 8,074,631 B2
(45) Date of Patent: Dec. 13, 2011

(54) CIRCUIT CONFIGURATION FOR SWITCHING CURRENT FLOW THROUGH AN IGNITION COIL

(75) Inventors: Shike Hu, Reutlingen (DE); Rainer Topp, Reutlingen (DE); Thomas Jacke, Tuebingen (DE); Christian Pluntke, Hechingen (DE)

(73) Assignee: Robert Bosch GmbH, Stuttgart (DE)

( * ) Notice: Subject to any disclaimer, the term of this patent is extended or adjusted under 35 U.S.C. 154(b) by 239 days.

(21) Appl. No.: 12/316,298

(22) Filed: Dec. 10, 2008

(65) Prior Publication Data

US 2009/0241924 A1 Oct. 1, 2009

(30) Foreign Application Priority Data

Mar. 28, 2008 (DE) ..... 10 2008 000 871

(51) Int. Cl.
*F02P 3/05* (2006.01)

(52) U.S. Cl. ..... 123/644; 123/618

(58) Field of Classification Search ..... 123/644, 123/594, 618, 647, 690; 324/378, 380
See application file for complete search history.

(56) References Cited

U.S. PATENT DOCUMENTS

| | | | | |
|---|---|---|---|---|
| 3,882,840 | A * | 5/1975 | Adamian et al. | 123/644 |
| 3,949,722 | A * | 4/1976 | Linstedt et al. | 123/651 |
| 4,008,698 | A * | 2/1977 | Gartner | 123/611 |
| 4,204,508 | A * | 5/1980 | Jundt et al. | 123/609 |
| 4,248,200 | A * | 2/1981 | Sugiura et al. | 123/644 |
| 4,308,848 | A * | 1/1982 | Pfaff et al. | 123/618 |
| 4,380,989 | A * | 4/1983 | Takaki | 123/644 |
| 4,912,373 | A * | 3/1990 | Moreau | 315/209 R |
| 5,014,675 | A * | 5/1991 | Koiwa | 123/609 |
| 6,914,434 | B2 * | 7/2005 | Bolz | 324/380 |

* cited by examiner

*Primary Examiner* — Erick Solis
*Assistant Examiner* — Sizo Vilakazi
(74) *Attorney, Agent, or Firm* — Kenyon & Kenyon LLP

(57) ABSTRACT

A circuit configuration for switching current flow through an ignition coil, in which the switching process is able to be executed by at least one first transistor that is controllable by a control signal which is able to be supplied via a control signal input of the circuit configuration, and the control signal input is connected to at least one variable resistor.

10 Claims, 2 Drawing Sheets

CIRCUIT CONFIGURATION FOR SWITCHING CURRENT FLOW THROUGH AN IGNITION COIL

FIELD OF THE INVENTION

The present invention relates to a circuit configuration for switching current flow through an ignition coil, in which the switching process is able to be executed by at least one transistor that is controllable by a control signal which is able to be supplied via a control signal input of the circuit configuration.

BACKGROUND INFORMATION

It is understood from the related art that, for the initiation of the combustion process of an internal combustion engine having externally supplied ignition, one may conduct an electric current through a primary coil having a low number of turns wound onto an iron core. The center conductor of a spark plug is connected to a second coil that is situated on the same iron core and has a larger number of turns. At the time of the intended ignition, the current flow through the primary coil is interrupted. This leads to the induction of a high voltage in the second coil, which discharges in a spark in the air gap of the spark plug.

In order to be able to control the time of the interruption of the current flow, and with that the ignition time, using an engine control device, it is provided in the related art that one should interrupt the current flow using at least one switching transistor. The switching transistor is switched by a control signal, in this instance, which is generated in the engine control unit in a control circuit. In this instance, the ignition time for each individual ignition is determined, for example, using a characteristics map stored in the engine control unit, as a function of the respective operating state of the internal combustion engine.

Frequently it is provided that the engine control, with the control circuit, is situated in the vehicle at a spatially different place from the ignition coil and the transistor assigned for switching the current flow. In this case, a cable connection is provided between the two components. Such a cable connection may have an error during the operation of the vehicle. The cable connection may be interrupted, for example. Besides that, the insulation of the cable connection may be damaged, which mostly leads to a short circuit. Both errors are easy to detect in the control circuit. In the case of an interruption in the cable connection, the electric current transmitted via the cable connection drops below a specifiable boundary value. In the case of a short circuit, the current on the connecting line rises above a specifiable boundary value. If the current flowing over the line is greater than the first boundary value, but lower than the second boundary value, there exists a normal operation of the line connection and the switching transistor. The two boundary values are therefore adjusted to the required control current of the switching transistor.

Starting from this related art, the problem arises that when a switching transistor is exchanged for an equally functioning, but not identical type, a different control current is required. If this control current is greater or less than the boundary values stored in the engine control unit, an error message is generated in the engine control unit, and the operation of the internal combustion engine becomes impossible.

Consequently, the present invention is based on the object of stating a circuit configuration for switching current flow through a coil, which is able to replace a multitude of functionally equal, but not identical circuit configurations, without having an error message generated in the engine control unit.

The object is attained, according to the present invention, by a circuit configuration for switching current flow through an ignition coil, in which the switching process is able to be executed by at least one first transistor that is controllable by a control signal which is able to be supplied via a control signal input of the circuit configuration, and the control signal input is connected to at least one variable resistor.

It is proposed, according to the present invention, to position a component having a variable electrical resistance at the control signal input of the circuit configuration, which is provided to accept a control signal that is generated in the engine control unit. Using this resistance element, the input current of the circuit configuration is able to be adjusted. In this way it is possible to set the input current to a specifiable setpoint value, so that the current supplied by the control circuit is able to be adjusted within limits within which the error monitoring of the control circuit does not report any error operation.

The variable resistance element may be situated both in series with the switching transistor, so that a specifiable voltage value drops off at the resistance element, and in parallel, so that a power loss is shunted to ground via the resistance element. In the one case, the input resistance of the circuit configuration is able to be increased by the variable resistance element beyond the input resistance of the switching transistor, and in the other case, the resistance is able to be reduced.

The switching transistor provided for switching the current flow through the ignition coil may, for instance, be a field-effect transistor or an IGBT. The use of a bipolar transistor is especially preferred. Furthermore, the circuit configuration may have additional components in order, for example, to detect an overvoltage at the ignition coil, an overcurrent or an over temperature of the at least one switching transistor, and in order to implement protective circuits which avoid the failure of these components.

In one refinement of the present invention, a measuring resistor is also provided in order to monitor the current flow through the variable resistance element. Using a regulating device that is occasionally provided, the measured actual value is able to be adjusted to a specifiable setpoint value by adjusting the variable resistance element in such a way that the circuit configuration takes up a specifiable input current. In this way, the input current is able to be held constant, even in response to a changing supply voltage. Changing supply voltages occur in motor vehicles particularly during the starting process, when the battery is stressed by the electrical starter, but the generator does not yet supply any charging voltage.

The variable resistance element may be switched either stepwise, or may be provided for the continuous changing of its resistance value. A continuous change is implementable particularly by using at least one transistor as resistance element. In this context, what may be involved is either the collector-emitter path of a bipolar transistor or the channel region of a field-effect transistor. The resistance of a collector-emitter path is able to be continuously influenced via the basic current applied. The resistance of a channel region is able to be influenced via the gate voltage applied. In order to implement a stepped switchover of the input resistance, at least one resistance element is able to be connected to the control signal input of the circuit configuration using a switch. A field-effect transistor or a bipolar transistor or a DIP switch is particularly suitable as an electric switch.

Preferably, but not necessarily, the circuit configuration proposed by the present invention is located in the same housing as the ignition coil and the ignition transformer. A compact component then comes about, which is able to be protected well from spray water and environmental influences, and which requires only one error-prone cable connection to the engine control unit for transmitting the control signal. The reliability may be increased further if the circuit configuration, proposed according to the present invention, is integrated monolithically on a single semiconductor substrate.

The present invention will be explained in greater detail below, in light of exemplary embodiments, which are partially shown in the attached figures.

DETAILED DESCRIPTION

Figure 1:
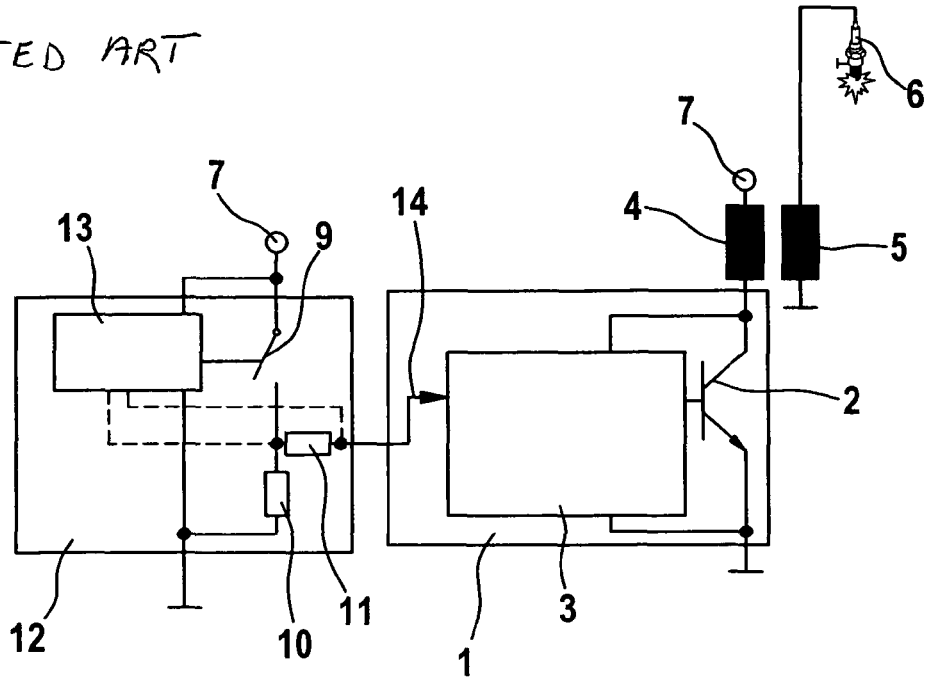
Fig. 1 RELATED ART
FIG. 1 shows a circuit configuration for switching current flow through an ignition coil, according to the related art.

FIG. 1 shows a circuit configuration 1 for switching current flow through the primary winding of an ignition coil 4, according to the related art. A control signal is supplied to circuit configuration 1 via line 14, using a control circuit 12.

The primary winding of ignition coil 4 has a terminal contact 7, which is connected to a voltage supply, for instance, a vehicle battery. The current flows over terminal contact 7 through ignition coil 4 to the collector input of a switching transistor 2. If switching transistor 2 is conducting, the current flows on to the emitter output of switching transistor 2, and from there to a ground connection. Ignition coil 4 is located on an iron core, which also carries the second coil 5. The number of turns of second coil 5 is greater than that of coil 4.

In order to trigger an ignition spark at spark plug 6, control circuit 12 generates a control signal which is supplied to circuit configuration 1 via control signal input 14. Inside circuit configuration 1 there is a logic circuit 3. This influences the basic current of switching transistor 2 as a function of the control signal, so that the collector-emitter path of transistor 2 becomes highly resistive at the ignition point. Because of that, the current flow from terminal 7 via coil 4 grinds to a halt. This sudden collapse of the current flow induces a voltage peak in coil 5. This voltage peak discharges over the air gap of spark plug 6. The spark created thereby ignites the mixture in the combustion chamber of the internal combustion engine.

As switching transistor 2 one may use, for example, an IGBT, a bipolar transistor or a field-effect transistor. In the example shown, transistor 2 is an IGBT. From case to case, a plurality of transistors may also collaborate in executing the switching function of transistor 2.

In the exemplary embodiment according to FIG. 1, transistor 2 acts as a series connection. From case to case, one skilled in the art may also provide using a transistor in parallel to coil 4, in order thereby to draw supply voltage 7 to a ground terminal. This leads to the breakdown of the current flow through coil 4.

Furthermore, logic circuit 3 is able to measure the temperature of transistor 2, the current flow through transistor 2 or the voltage created at coil 4 via additional connecting lines, and compare them to specifiable setpoint values. Logic circuit 3 may be prepared to carry out measures for component protection when these setpoint values are exceeded, in this context.

Between control circuit 12 and control signal input 14 there is a connecting line. The state of this connecting line is monitored in control circuit 12, so as to detect any interruption or short circuit in the line.

Control circuit 12 may, for example, be a component of an engine control unit. Control circuit 12, in turn, has a terminal 7 for connecting to a supply voltage. Moreover, control circuit 12 has a logic circuit 13 which conducts a current pulse to control signal input 14 at the ignition point and monitors the strength of the current flowing in the connecting line.

A measuring resistor 11 is available for monitoring the strength of the current. Measuring resistor 11, that lies serially in the connecting line, directly measures the current flowing in the connecting line to control signal input 14, and may therefore be drawn upon directly to determine if there is any damage to the connecting line. In response to a short circuit in the connecting line, the current flowing through resistor 11 will increase greatly. In response to an interruption in the connecting line, no measurable current will flow through resistor 11.

The threshold values stored in logic circuit 13, for the voltage drop over measuring resistor 11 are given by the input resistance of control signal input 14 and supply voltage 7. The threshold values are established, in this context, in such a way that even when there is fluctuation in the supply voltage and the input resistance within the admissible range, all the occurring measured values of the current lie within the established boundary values.

If an exchange of circuit configuration 1 becomes necessary during the service life of the control unit having control circuit 12, logic circuit 13 in control circuit 12 is able to detect an error even in a flawless operation of circuit configuration 1, if the input resistance, and with that, the current consumption of control signal input 14 from the newly added circuit configuration 1, differs from the input resistance of circuit configuration 1 that had been used up to the present. This may particularly occur if the type of switching transistor 2 used changes. Thus, field-effect transistors or IGBT's have a higher input resistance, and therefore a lower basic current than bipolar transistors. Furthermore, the input resistance of the circuits used for controlling the switching transistors may also be different.

Figure 2:
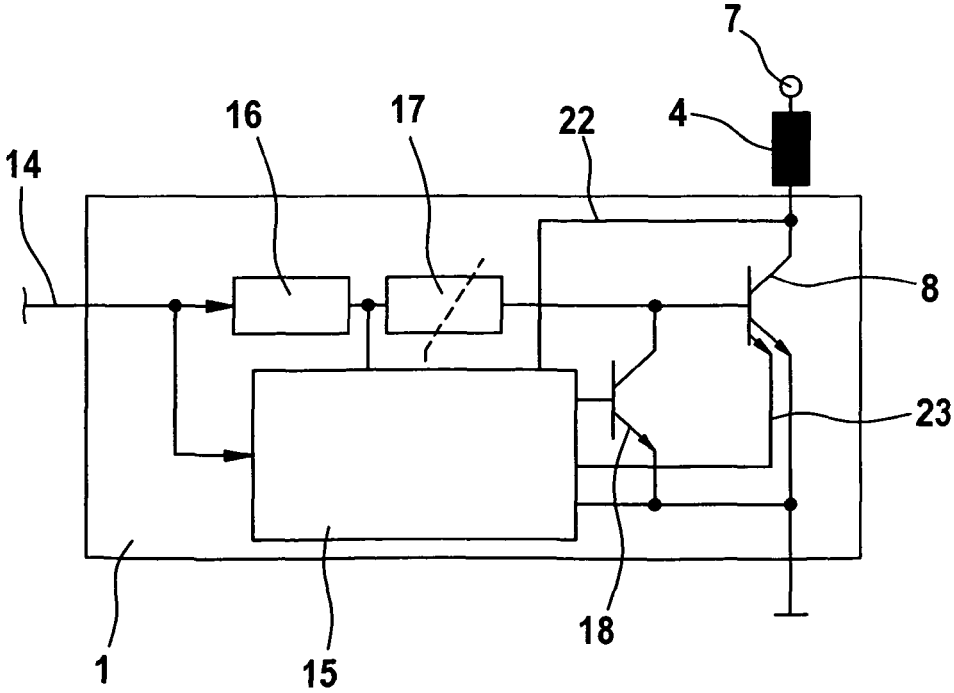
FIG. 2 shows a block diagram of a circuit configuration according to the present invention.

FIG. 2 shows a circuit configuration 1 according to the present invention. The current flow through primary coil 4 of an ignition transformer is interrupted using a transistor 8, in this instance. In the exemplary embodiment as in FIG. 2, this switching function is executed by a bipolar transistor 8. From case to case, one skilled in the art might also provide field-effect transistors or IGBT's for this. A plurality of transistors may also be used to execute the switching function. Second coil 5 and spark plug 6 are not shown in FIG. 2, for the sake of clarity.

In order to influence the electrical resistance of the collector-emitter path of transistor 8, a basic current is applied to it. The basic current is supplied to the circuit configuration via control signal input 14. Control circuit 12 required for this is also not shown in FIG. 2, for the sake of clarity.

The current supply to the base of transistor 8 takes place via resistors 16 and 17. Resistor 16 is a measuring resistor, in this context. The basic current flowing through measuring resistor 16 generates a voltage drop at measuring resistor 16 which is directly proportional to the flowing basic current. This voltage drop is supplied to logic circuit 15 as the current's actual value. Moreover, the basic current flows through variable resistance element 17. The resistance value of resistance element 17 is influenced by logic circuit 15 through a control signal or regulation signal. If logic circuit 15 includes a regulating device, the basic current is able to be regulated to a specifiable setpoint value. This setpoint value is selected so that it lies between the boundary values stored in logic circuit 14 of control circuit 12.

The electrical resistance of variable resistance element 17 may be variable in a stepwise or a continuous manner, in this instance. In the case of stepwise variability, discrete resistance elements may be coupled into the current path or separated from it, using assigned circuit configurations. A continuously variable resistance element may be formed by one or more transistors, for example.

Furthermore, logic circuit 15 includes additional functions for monitoring the current flowing in transistor 8 and for monitoring the voltage present at coil 4. Connection 22 is used for monitoring the voltage. For instance, the voltage measured at coil 4 via line 22 may increase to above a boundary value stored in logic circuit 15 if the spark plug is defective or if the engine control unit is being operated without a spark plug being inserted. In this case, logic circuit 15 is able to make the collector-emitter path of transistor 8 conducting again by influencing the basic current, in order to lead off the voltage peak via transistor 8 to the ground terminal.

In order to monitor the current flowing through coil 4 and transistor 8, transistor 8, in the exemplary embodiment according to FIG. 2, has an additional emitter output, which is connected to logic circuit 15 via line 23. If the current measured via line 23 exceeds a boundary value, the basic current supplied to transistor 8 is able to be led off to ground via a parallel transistor 18. Because of this, a lower basic current reaches transistor 8. The collector-emitter path thereby becomes highly resistive and the current flowing through coil 4 becomes limited.

FIG. 3 again shows an exemplary embodiment for a circuit configuration 1 having a measuring resistor 16 and a variable resistance element 19, which regulates the input resistance of a control signal input 14 to a specifiable setpoint value.

Figure 3:
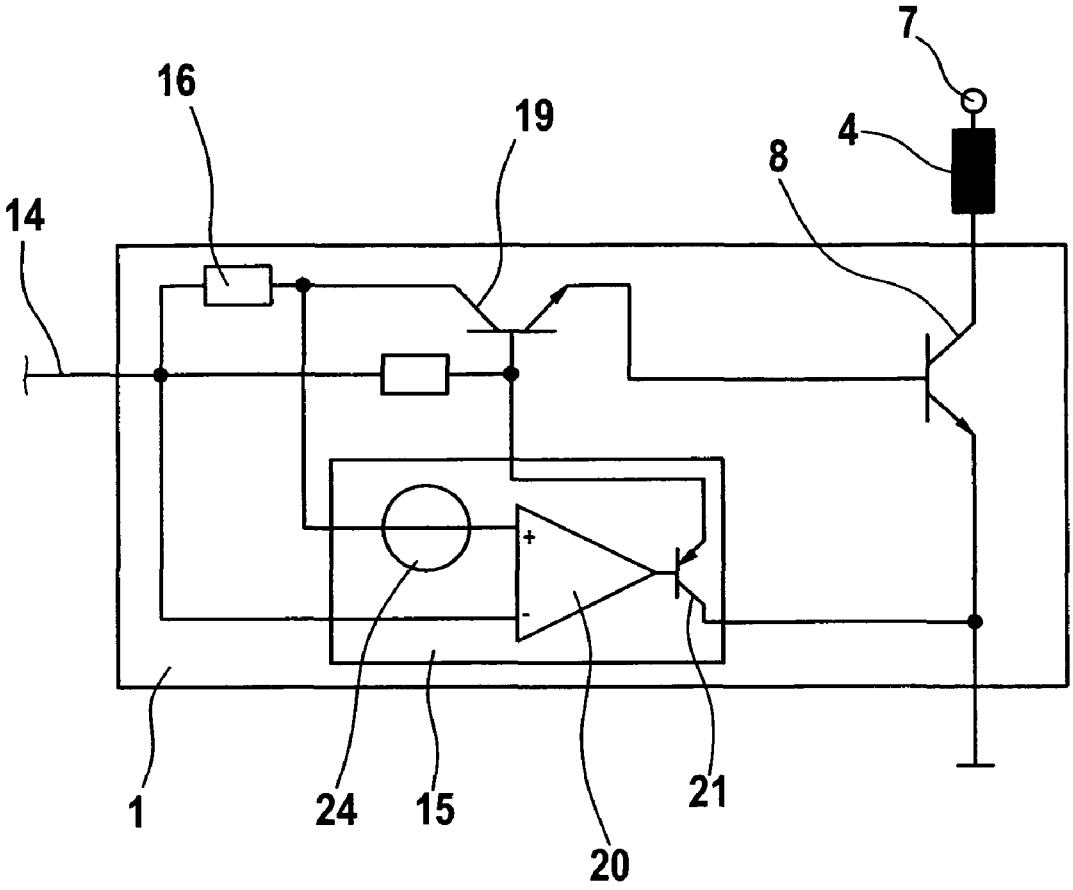
FIG. 3 shows an exemplary embodiment of a circuit configuration according to the present invention.

In the exemplary embodiment according to FIG. 3, a primary winding 4 is also provided which is in connection with a voltage source via terminal 7. The ground terminal of coil 4 proceeds over the collector-emitter path of a bipolar transistor 8. The current flowing over the collector-emitter path and thus through coil 4 is influenced by a supplied basic current that is supplied by a control signal input 14.

This basic current first flows through measuring resistor 16. Because of that, a voltage drops off at measuring resistor 16 which generates a control signal at the output of comparator 20. Comparator 20, in this instance, is a component of logic circuit 15, which is a component of circuit configuration 1 and is used for regulating the current flowing via input 14. In this context, the output signal of the comparator is proportional to the difference of the input voltages, so that the setpoint value specification is able to take place by a voltage source which just compensates for the voltage drop over measuring resistor 16 when input current 14 is equivalent to the setpoint value.

The output signal of comparator 20 is amplified via a transistor 21. This amplified output signal forms the basic current for an additional transistor 19. The collector-emitter path of transistor 19 forms the variable resistance element 17. In this case, the resistance changes continuously with the basic current present at transistor 19. In this way, the input resistance of control signal input 14 of circuit configuration 1 is regulated in such a way that the input current flowing over control signal input 14 is limited to a specifiable boundary value. This boundary value is selected so that it lies within the boundary values stored in logic circuit 13 of control circuit 12. Consequently, circuit configuration 1 is able to be operated on a plurality of control circuits 12, independently of the basic current required by transistor 8. That being the case, a bipolar transistor 8, for example, may be used in circuit configuration 1, which requires a comparatively high basic current, even when circuit configuration 1 is being used as an exchange element for a circuit configuration which had originally included an IGBT 2 as switching element having a lower basic current.

Of course, it is made a matter of choice to one skilled in the art to have logic circuit 15 carry out additional functions, such as voltage monitoring and/or current monitoring of ignition coil 4. However, the circuit components required for this are not shown in FIG. 3, for reasons of clarity.

What is claimed is:

1. A circuit configuration for switching a current flow through an ignition coil, comprising:

at least one first transistor to perform the switching process, and which is controllable by a control signal;

at least one variable resistance element; and a measuring resistor connected in series with the at least one variable resistance element and connected in parallel with the ignition coil, the circuit configuration being configured to determine the current flowing through the at least one variable resistance element by measuring a voltage across the measuring resistor, wherein the control signal is suppliable via a control signal input of the circuit configuration, and wherein the control signal input is connected to the at least one variable resistance element and the measuring resistor.

2. The circuit configuration of claim 1, wherein the at least one first transistor includes at least one bipolar transistor, whose collector-emitter path is provided for forming a series connection to the ignition coil.

3. The circuit configuration of claim 1, wherein at least one variable resistance element is formed by a second transistor.

4. The circuit configuration of claim 3, wherein the resistance element is formed by the collector-emitter path of at least one bipolar transistor.

5. The circuit configuration of claim 1, further comprising:

a regulating device that is able to act upon the variable resistance element, so as to regulate the current flowing via the control signal input to a specifiable setpoint value.

6. The circuit configuration of claim 1, wherein at least one electrical resistor is connectable to the control signal input.

7. The circuit configuration of claim 1, wherein the measuring resistor is connected in series with the collector-emitter path of at least one second bipolar transistor, which forms the variable resistance element, and wherein the variable resistance element influences a basic current of the at least one first transistor, which is provided to switch the current flow through the ignition coil.

8. The circuit configuration of claim 1, wherein the circuit configuration is monolithically integrated on a single semiconductor substrate.

9. The circuit configuration of claim 1, wherein the circuit configuration is integrated with an ignition coil in a housing.

10. A motor vehicle arrangement, comprising:

a motor vehicle; and a circuit configuration for switching a current flow through an ignition coil, including:

at least one first transistor to perform the switching process, and which is controllable by a control signal;

at least one variable resistance element; and a measuring resistor connected in series with the at least one variable resistance element and connected in parallel with the ignition coil, the circuit configuration being configured to determine the current flowing through the at least one variable resistance element by measuring a voltage across the measuring resistor, wherein the control signal is suppliable via a control signal input of the circuit configuration, and wherein the control signal input is connected to the at least one variable resistance element and the measuring resistor.

* * * * *